US010252104B2

(12) United States Patent
Polenz

(10) Patent No.: US 10,252,104 B2
(45) Date of Patent: Apr. 9, 2019

(54) SPORTS MAT

(71) Applicant: Christian Polenz, Hamburg (DE)

(72) Inventor: Christian Polenz, Hamburg (DE)

( * ) Notice: Subject to any disclaimer, the term of this patent is extended or adjusted under 35 U.S.C. 154(b) by 77 days.

(21) Appl. No.: 15/328,261

(22) PCT Filed: Jul. 22, 2015

(86) PCT No.: PCT/EP2015/066729

§ 371 (c)(1),
(2) Date: Jun. 30, 2017

(87) PCT Pub. No.: WO2016/012487

PCT Pub. Date: Jan. 28, 2016

(65) Prior Publication Data

US 2017/0291063 A1 Oct. 12, 2017

(30) Foreign Application Priority Data

Jul. 23, 2014 (DE) ..... 10 2014 110 378

(51) Int. Cl.
*A63B 23/04* (2006.01)
*A63B 6/00* (2006.01)
(Continued)

(52) U.S. Cl.
CPC ..... *A63B 23/0458* (2013.01); *A63B 6/00* (2013.01); *A63B 21/00047* (2013.01); *A63B 21/028* (2013.01); *A63B 21/4037* (2015.10)

(58) Field of Classification Search
CPC . A63B 23/0458; A63B 6/00; A63B 21/00047; A63B 21/4037; A63B 2023/006; A63B 2023/0411; A63B 23/04; A63B 2208/0204; A63B 23/00; A63B 2071/027; A63B 23/10; A47G 9/062; A47G 27/0237; A47G 9/06; A47G 9/02; A47G 9/086; A47G 27/0206; A47G 9/064; A47G 11/003; A47G 2200/106; A47G 27/0225;
(Continued)

(56) References Cited

U.S. PATENT DOCUMENTS 4,063,319 A * 12/1977 Smith ..... A47G 9/02 5/416
5,102,129 A 4/1992 Roberts
(Continued)

FOREIGN PATENT DOCUMENTS

WO 2011 130 607 10/2011

OTHER PUBLICATIONS

Health-T Fitness Mat. http://www.getnews.info/549119/healtht-fitness-mat-a-revolutionary-yoga-mat-that-will-provide-harmonious-exercises-to-practitioners.html. Published May 11, 2016. Accessed May 31, 2018.*

*Primary Examiner* — Andrew S Lo
(74) *Attorney, Agent, or Firm* — Bay State IP, LLC

(57) ABSTRACT

The invention relates to a sports mat which consists of a flexible material and has a longitudinal direction (L) and a transverse direction (Q) perpendicular thereto, comprising a rectangular mat longitudinal subarea (2) and a rectangular mat transverse subarea (3) which intersects the mat longitudinal subarea (2) forming a T shape, an extension of the mat longitudinal subarea (2) in the transverse direction (Q) along a leg section (6) of the T being not more than half the size than a longest transverse extension of the mat transverse subarea (Q).

4 Claims, 4 Drawing Sheets

Figure 1:
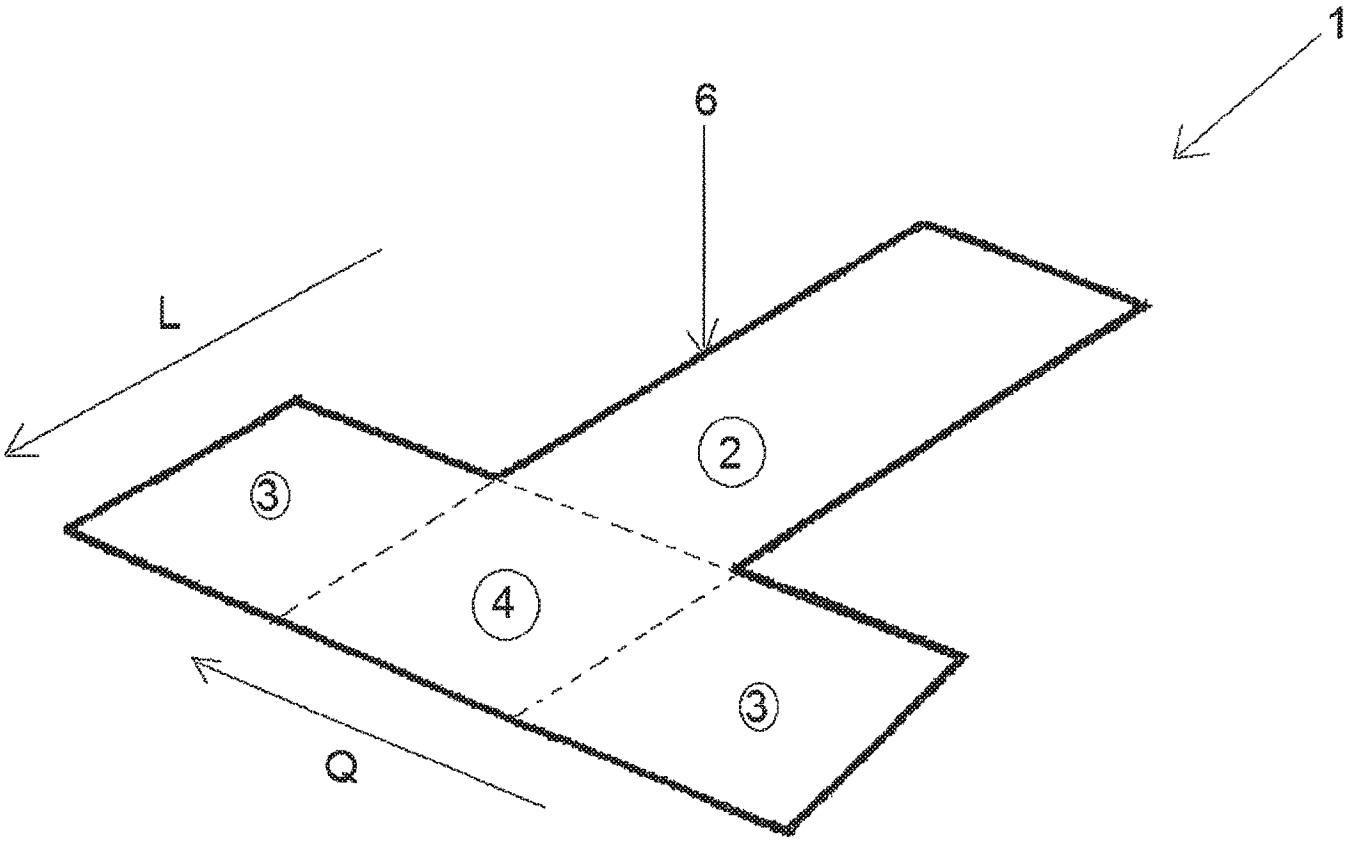

(51) Int. Cl.
*A47G 9/06* (2006.01)
*A63B 21/02* (2006.01)
*A63B 21/00* (2006.01)

(58) Field of Classification Search
CPC ..... A47G 27/025; A47G 27/0293; A47G 33/008; A47G 9/0207; A47G 9/0223; A47G 9/0238; A47G 9/0246; A47G 9/066; A47G 9/08; A47G 9/083; A47G 9/1027
USPC ..... 5/417
See application file for complete search history.

(56) References Cited

U.S. PATENT DOCUMENTS 5,591,105 A * 1/1997 Dalebout ..... A63B 23/0458 248/188.2
6,117,051 A * 9/2000 Suarez ..... A63B 21/078 482/51
6,387,013 B1 5/2002 Marquez
7,568,245 B2 * 8/2009 Milam ..... A47G 9/086 5/413 R
D674,225 S * 1/2013 Boyer ..... D6/582
8,607,381 B2 * 12/2013 Woods ..... A63B 21/4037 5/417
8,794,975 B2 8/2014 Davey
2007/0226904 A1 * 10/2007 Huffman ..... A63B 23/12 5/417
2009/0241260 A1 * 10/2009 Noonan ..... A63B 21/4037 5/417
2009/0276957 A1 11/2009 Boitet-Ball
2010/0081549 A1 * 4/2010 Thompson ..... A63B 5/11 482/27
2010/0306917 A1 * 12/2010 Batiste ..... A47G 27/0237 5/420
2012/0210512 A1 * 8/2012 Woods ..... A47G 27/0237 5/417
2015/0231437 A1 * 8/2015 Welsh ..... A63B 21/068 482/142

* cited by examiner

SPORTS MAT

The invention relates to a sports mat.

Sports mats are, of course, well known from the prior art.

Sports mats conventionally have a simple, usually linear or rectangular form with dimensions of approximately 1.80 m in the longitudinal direction, approximately 55 cm in terms of width and approximately 1 cm in terms of depth. The sports mats consist homogeneously of a plastic material which is elastic and flexible so that, on the one hand, the mat can be rolled up or folded and, on the other, it serves as a springy or soft pad when the sportswoman or sportsman is supported on the floor and would like to perform fitness, stretching or relaxation exercises.

WO 2011/130607 A1 discloses a step having an impact-absorbing coating on the stepping area.

U.S. Pat. No. 8,794,975 B2 discloses a training system for developing motor and cognitive skills, in which different patterns, which contain steps or other instructions, are applied to a mat. By carrying out these instructions, the person is prompted to perform movement exercises.

Sports mats are used in combination with steps for a range of fitness exercises. A step is a piece of sports equipment whereof the height above the floor is adjustable and which provides a height-adjustable stepping and supporting area above the sports floor.

On the one hand, sports mats and steps are disadvantageous in that they are not matched to one another in terms of their size and their proportions. When placing the sports mat on the stepping/supporting area of the step, the sports mat hangs or protrudes over the step at the sides in the transverse direction and/or in the longitudinal direction with the result that the stepping/supporting area for the sportswoman or sportsman is no longer discernable and therefore poses a certain safety risk. On the other hand, the conventional mats are further disadvantageous in that, with a change of exercise from the step to the floor and vice versa, they have to be moved back and forth between the step and the floor and realigned, which requires time and effort.

The object of the invention is to provide a sports mat which reduces the above-mentioned disadvantages.

The object is achieved by a sports mat mentioned at the outset, which has the features of Claim 1.

The sports mat according to the invention breaks with the conventional image of a substantially rectangular sports mat. The sports mat according to the invention is preferably formed completely and homogeneously from a flexible and elastic material, in particular rubber, cellular rubber, foam rubber of soft rubber. It can be formed in particular from PVC or polypropylene. It has a longitudinal and a transverse direction and a rectangular longitudinal mat subarea as well as a rectangular transverse mat subarea intersecting the longitudinal mat subarea in a T shape, wherein an extent of the longitudinal mat subarea in the transverse direction along a T-leg portion is no more than ⅔, preferably no more than ½, the size of a longest transverse extent of the transverse mat subarea.

The sports mat according to the invention can be formed in a strict T shape as seen in plan view. However, additional mat subareas which, as a whole, give the sports mat an overall shape which deviates from the strict T shape, can also be provided, in particular at the sides of the transverse mat subarea.

However, it is also conceivable for the transverse mat subarea and longitudinal mat subarea to intersect in a T shape and for two triangular mat subareas to be integrally formed at the two sides of the transverse mat subarea which face the T-leg, which triangular mat subareas are integrally connected to a respective longitudinal side of the longitudinal mat subarea. In a further embodiment of the sports mat, a circular mat subarea is provided at a side of the transverse mat subarea which is remote from the T-leg. Instead of the circular mat part, a rectangular mat part can also be provided at the side of the transverse mat subarea which is remote from the T-leg, which rectangular mat part realises a cruciform outer structure over the sports mat as a whole. A free end of the T-leg can be formed in a tapered manner or have different lengths. A side of the transverse mat subarea which is remote from the T-leg can be shaped such that it is rounded to the outside. Combinations of the embodiments mentioned are also conceivable.

Sports mats with rounded outer T-arm sides, which are intended to be supported on steps which are rounded along the short sides, are also possible.

Further outer forms of the sports mat subarea which consistently exhibit the strictly T-shaped mat subform are also possible.

In a preferred embodiment of the invention, the transverse extent of the transverse mat subarea is 0.9 m±10 cm and the longitudinal extent of the longitudinal mat subarea is 1.30 m±10 cm. However, the intermediate sizes between 0.8 m and 1.0 m and between 1.20 m and 1.40 m and combinations thereof are also disclosed. The thickness of the sports mat is preferably 1.5 cm±0.5 cm. All intermediate sizes between 0.5 cm, 1.0 cm and 2 cm are also disclosed here. The dimensions are to no extent limited to the sizes given. It is also possible to realise even greater and even smaller dimensions in special cases.

The object is also achieved by a sports-equipment arrangement having the features of Claim 6, wherein the sports-equipment arrangement comprises a step and one of the above-mentioned mats according to the invention.

The step has a stepping/supporting area which preferably has the dimensions 0.9 m±10 cm×35 cm±10 cm. The stepping/supporting area corresponds to the dimensions of the transverse mat subarea. The step is conventionally height-adjustable in three levels. Different steps are available; amongst others, steps from the company Reebok®. All forms of step are included and disclosed here. Essential to the invention is the adaptation of the size of the transverse mat subarea to the size of the stepping/supporting area of the step on the one hand and the provision of a conventional large mat through the longitudinal mat subarea on which the sportswoman or sportsman can be supported on the floor and, additionally, the enabling of alternate training on the step and on the floor without interruptions owing to rearrangements. However, the T-leg of the longitudinal mat subarea can also be folded or rolled up and thus stored under the step or pulled or pushed through under the step.

Figure 2:
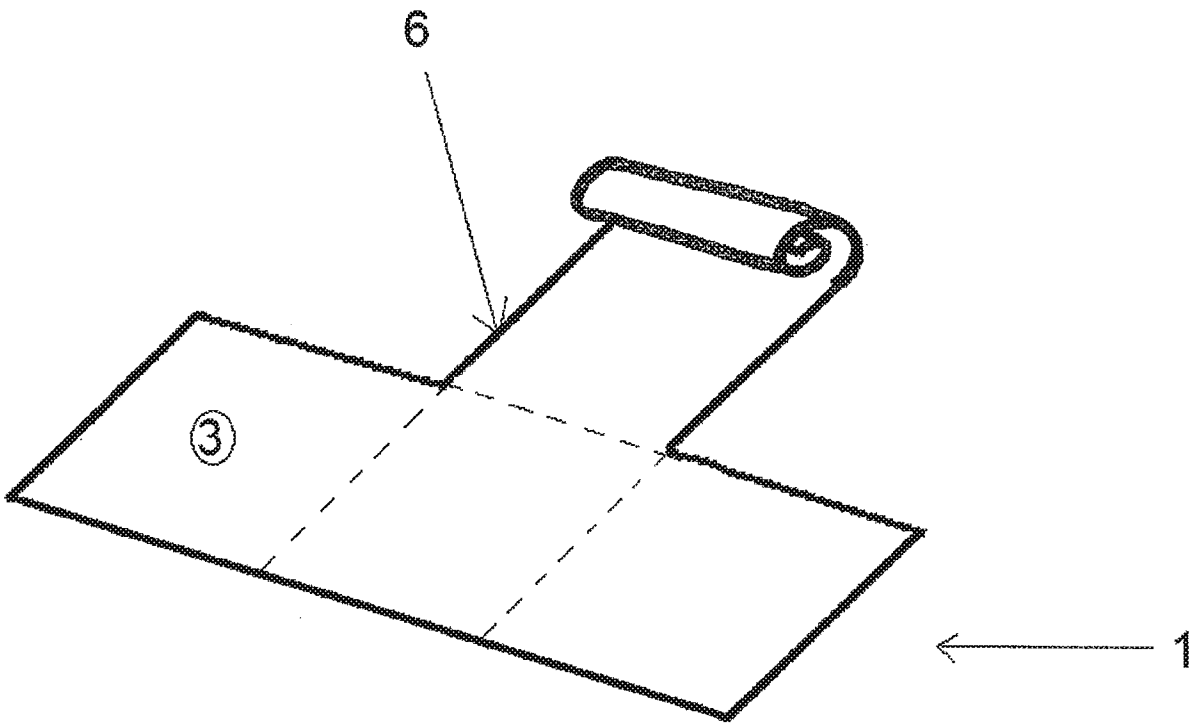
Figure 3:
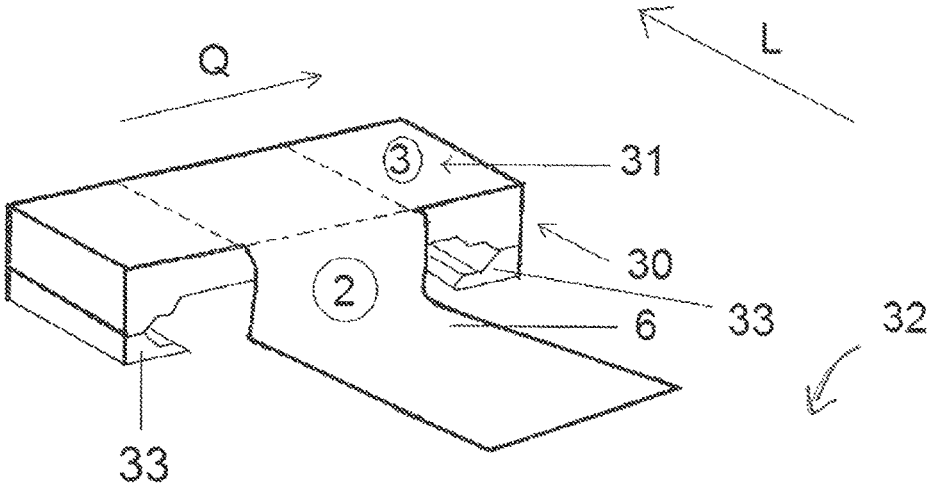
Figure 4:
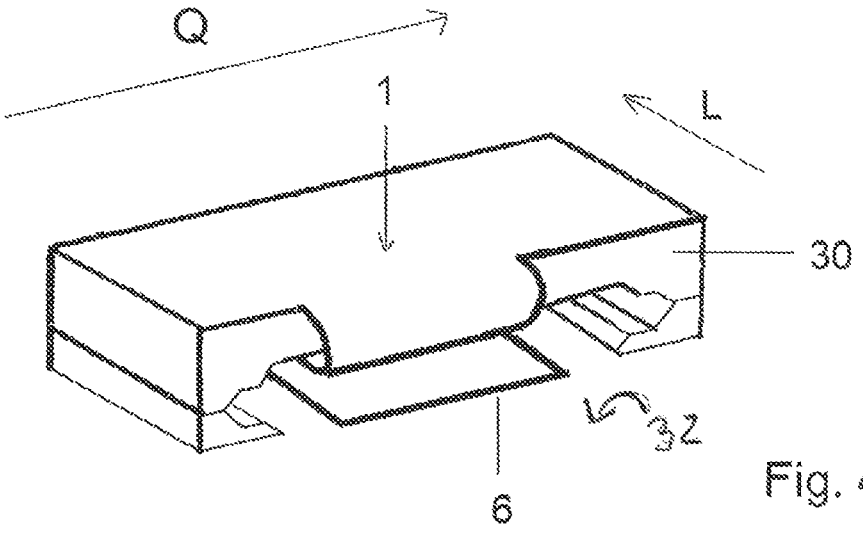

The invention is described with reference to an exemplary embodiment in four figures, which show:

FIG. 1 a sports mat according to the invention in a perspective view, supported on the floor;

FIG. 2 the sports mat in FIG. 1 in a partially rolled-up state;

FIG. 3 a sports-equipment arrangement according to the invention, having a sports mat in FIG. 1, which is supported with a transverse mat subarea on a step, and a longitudinal mat subarea which is partially supported on the floor;

FIG. 4 the sports-equipment arrangement in FIG. 3 having a longitudinal mat subarea pushed together under the step.

The inventive sports mat 1 illustrated in FIG. 1 is made from a flexible plastic material in one piece. The sports mat 1 consists homogeneously of the same plastic material over its entire extent. The sports mat 1 has a thickness of 1-2 cm, in particular 1.5 cm. The sports mat 1 has a longitudinal direction L and a transverse direction Q, which extend in each case perpendicularly to one another and in each case perpendicularly to the extent of the thickness. An extent of the sports mat in the longitudinal direction L is 1.30 m. A maximum extent of the sports mat in the transverse direction Q is 0.90 m. In a plan view, the sports mat has a T-shaped outer contour with a T-leg portion 6 and two T-arm portions.

The sports mat 1 illustrated in FIG. 1 has a rectangular longitudinal mat subarea 2 and a likewise rectangular transverse mat subarea 3. The longitudinal mat subarea 2 and the transverse mat subarea 3 intersect in a common intersection region 4. An extent of the longitudinal mat subarea 2 in the transverse direction Q is 42 cm along the T-leg portion 6, an extent of the transverse mat subarea 3 in the longitudinal direction L is 35 cm.

FIG. 2 shows the sports mat 1 in FIG. 1 with the rolled-up T-leg portion 6. The sports mat 1 can also be rolled up further in the direction of the transverse mat subarea 3 and can be easily transported in the rolled-up state.

FIG. 3 shows a sports-equipment arrangement according to the invention, having a conventional step 30 and the inventive sports mat 1 of FIGS. 1 and 2. The step 30 has a stepping/supporting area 31, which is 35 cm in the longitudinal direction and 90 cm in the transverse direction. The transverse mat subarea 3 is dimensioned such that it corresponds exactly to the dimensions of the stepping/supporting area 31 of the step 30 and is thus supported over its full area on the stepping/supporting area 31. The T-leg portion 6 of the longitudinal mat subarea 2 hangs down to a floor 32 in the longitudinal direction L in front of the stepping/supporting area 31 of the step 30 and is supported on the floor 32 there, guided away from the step 30.

FIG. 4 shows a further modified sports-equipment arrangement comprising the step 30 and sports mat 1 in FIG. 3, wherein the T-leg portion 6 is initially guided back under the step 30 and then to the front again. The T-leg portion 6 is pushed together under the step 30. However, the T-leg portion 6 can also be rolled up under the step 30 or pulled through under the step 30. The transverse extent of the T-leg portion 6 of the longitudinal mat subarea is dimensioned at 42 cm so that it fits between feet 33 of the positioned step 30, even when the feet 33 are set in the lowest position (not shown in FIG. 3). The step 30 in FIG. 3 is height-adjustable in three positions and is shown in the highest position in FIG. 3.

LIST OF REFERENCE CHARACTERS

1 Sports mat
2 Longitudinal mat subarea
3 Transverse mat subarea
4 Intersection region
6 T-leg portion
30 Step
31 Stepping/supporting area
32 Floor
33 Foot
L Longitudinal direction
Q Transverse direction

The invention claimed is:

1. A sports-equipment arrangement having a sports mat comprising:

a flexible material with a longitudinal direction and a transverse direction provided perpendicularly thereto, having a rectangular longitudinal mat subarea and a rectangular transverse mat subarea intersecting the longitudinal mat subarea in a T-shape;

wherein an extent of the longitudinal mat subarea in the transverse direction along a T-leg portion is no more than half the size of a longest transverse extent of the transverse mat subarea; and a step wherein the step has a stepping area having a step width and a step length and a transverse extent of the transverse mat subarea corresponds to the step width and a longitudinal extent of the transverse mat subarea corresponds to the step length so that the stepping area has dimensions that corresponds to the dimensions of the transverse mat subarea when the transverse mat subarea is placed on top of the stepping area and the T-leg portion of the longitudinal mat subarea which is remote from the transverse mat subarea is supported on a floor when the step is standing on the floor.

2. The sports-equipment arrangement according to claim 1, wherein the longitudinal mat subarea and transverse mat subarea intersect in a T-shape.

3. The sports-equipment arrangement according to claim 1, wherein the transverse extent of the transverse mat subarea is 1.0 m±10 cm and a longitudinal extent of the longitudinal mat subarea is 1.8 m±10 cm.

4. The sports-equipment arrangement according to claim 1, wherein the flexible material is a material selected from the group consisting of: rubber, cellular rubber, foam rubber and soft rubber.

* * * * *